US008578746B2

(12) United States Patent
Watabe

(10) Patent No.: US 8,578,746 B2
(45) Date of Patent: Nov. 12, 2013

(54) RING SUPPORTING DEVICE

(75) Inventor: Yoshiharu Watabe, Iruma (JP)

(73) Assignee: Honda Motor Co., Ltd., Tokyo (JP)

( * ) Notice: Subject to any disclaimer, the term of this patent is extended or adjusted under 35 U.S.C. 154(b) by 273 days.

(21) Appl. No.: 13/255,963

(22) PCT Filed: Jan. 15, 2010

(86) PCT No.: PCT/JP2010/050371

§ 371 (c)(1),
(2), (4) Date: Sep. 12, 2011

(87) PCT Pub. No.: WO2010/106829

PCT Pub. Date: Sep. 23, 2010

(65) Prior Publication Data

US 2012/0000868 A1 Jan. 5, 2012

(30) Foreign Application Priority Data

Mar. 16, 2009 (JP) ..... 2009-063191

(51) Int. Cl.
*C21D 9/40* (2006.01)
*B21D 26/02* (2011.01)

(52) U.S. Cl.
USPC ..... 72/56; 72/61; 72/226; 269/267

(58) Field of Classification Search
USPC ..... 248/160, 176.1, 560, 63; 72/54, 61, 72/364, 226; 269/267, 287; 211/13.1, 211/59.1, 49.1; 206/303
See application file for complete search history.

(56) References Cited

U.S. PATENT DOCUMENTS

| | | | | |
|---|---|---|---|---|
| 4,577,756 | A * | 3/1986 | Hennessy et al. | 206/308.3 |
| 8,292,074 | B2 * | 10/2012 | Fiore | 206/335 |
| 2011/0252852 | A1 * | 10/2011 | Watabe et al. | 72/54 |
| 2012/0148968 | A1 * | 6/2012 | Watabe et al. | 432/1 |

FOREIGN PATENT DOCUMENTS

| | | | |
|---|---|---|---|
| EP | 1 801 245 | A1 | 6/2007 |
| JP | 2002-086322 | A | 3/2002 |
| JP | 2004-122277 | A | 4/2004 |
| JP | 2007-191788 | A | 8/2007 |

* cited by examiner

*Primary Examiner* — Amy J Sterling
(74) *Attorney, Agent, or Firm* — Carrier Blackman & Associates, P.C.; Joseph P. Carrier; William D. Blackman

(57) ABSTRACT

A ring supporting device is provided with six support shafts capable of approaching and separating from the inner walls of metal rings. Each of the support shafts has an exposed side wall having formed thereon annular ridges and grooves. The side walls of the support shafts each have cushioning materials having a height substantially corresponding to the height of each of the grooves. The cushioning materials deform when the inner walls of the metallic rings make contact with the cushioning materials, and this relaxes a force which tries to expand the metallic rings from the inner wall side to the outer wall side.

6 Claims, 9 Drawing Sheets

RING SUPPORTING DEVICE

TECHNICAL FIELD

The present invention relates to a ring supporting device for supporting ring members such as metal rings for use as continuously variable transmission (CVT) belts.

BACKGROUND ART

CVTs include a belt comprising a stacked ring assembly made up of a plurality of stacked metal rings for transmitting power. The metal rings are generally manufactured by cutting a hollow cylindrical drum constituted from maraging steel into a plurality of metal rings having a prescribed width, and then holding the metal rings on a rack as disclosed in Japanese Laid-Open Patent Publication No. 2007-191788 and performing a heating treatment process on the metal rings, such as a solution treatment process, an aging treatment process, or a nitriding treatment process.

FIG. 7 is a plan view of a ring supporting device 2 for supporting metal rings 1, and for feeding and transferring the metal rings 1 onto a rack. The ring supporting device 2 is mounted on the distal end of an arm of a feed robot (not shown), which also is referred to as a loader.

The ring supporting device 2 includes a fixed base 3 and a movable base 5, which is movable toward and away from the fixed base 3 by two cylinder columns 4*a*, 4*b*. The fixed base 3 and the movable base 5, which are substantially semicircular in shape, have respective straight portions facing each other, which are disposed substantially diametrically thereacross.

The cylinder columns 4*a*, 4*b* comprise cylinders having cylinder tubes 6*a*, 6*b* coupled to the fixed base 3, and rods 7*a*, 7*b* coupled to the movable base 5. As shown in FIGS. 7 and 8, when the rods 7*a*, 7*b* are extended and retracted, the movable base 5 is moved toward and away from the fixed base 3. As shown in FIG. 9, vertical support walls 8 extend from the fixed base 3 and the movable base 5.

The feed robot first places the ring supporting device 2 shown in FIG. 7 so as to face toward the inner walls of a plurality of the metal rings 1. Then, as shown in FIG. 8, the cylinder columns 4*a*, 4*b* are actuated to bring the support walls 8 of the fixed base 3 and the movable base 5 into abutment against the inner walls of the metal rings 1. The rods 7*a*, 7*b* are extended a predetermined distance in order to cause the support walls 8 (see FIG. 9) to support the metal rings 1, as the metal rings 1 are elastically deformed into an elliptical shape. The arm of the feed robot is then operated to feed the metal rings 1 together with the ring supporting device 2 toward the rack.

After the ring supporting device 2 has placed the metal rings 1 between a plurality of holding shafts of the rack, the rods 7*a*, 7*b* are retracted. As a result, all of the metal rings 1 are returned elastically to a circular shape, and inner walls thereof are spaced from the support walls 8, while the outer walls thereof are held against the side walls of the holding shafts, whereupon transfer of the metal rings 1 onto the rack is completed.

The metal rings 1, which are fabricated as described above, are not of constant dimensions, but inevitably suffer from variations due to the manufacturing process in relation to the inside diameters, circumferential lengths, and widths thereof, as disclosed in Japanese Laid-Open Patent Publication No. 2004-122277 and Japanese Laid-Open Patent Publication No. 2002-086322. In other words, the metal rings 1, which are supported by the ring supporting device 2, may have larger and smaller inside diameters, for example.

When the metal rings 1 are simultaneously supported on the support walls 8, the rods 7*a*, 7*b* need to be extended to positions where the rods 7*a*, 7*b* are capable of supporting the metal rings 1, in order to prevent metal rings 1 having a maximum inside diameter from dropping off from the support walls 8. In this case, since it is necessary to pull the metal rings 1 having smaller inside diameters, the cylinder columns 4*a*, 4*b* need to produce large actuating forces. Thus, the metal rings 1, which are pulled in this manner, may exceed an elastic deformation range and may become plastically deformed.

Consequently, the ring supporting device according to the background art is disadvantageous, in that the ring supporting device is large in size and heavy in weight, due to the need for cylinders that produce large actuating forces, and since some of the metal rings having smaller inside diameters tend to become plastically deformed.

SUMMARY OF THE INVENTION

A general object of the present invention is to provide a ring supporting device, which is small in size and light in weight.

A primary object of the present invention is to provide a ring supporting device, which is effective at preventing metal rings from becoming plastically deformed.

According to an embodiment of the present invention, there is provided a ring supporting device comprising a plurality of support members for simultaneously supporting a plurality of elastic ring members at inner walls thereof, wherein:

at least one of the support members is displaceable toward or away from the inner walls of the ring members;

at least one of the support members is covered with a plurality of elastic buffers; and when the ring members are supported by the support members, the buffers abut individually and respectively against the ring members.

With the above arrangement, when the support members are used to support all of the metal rings, the buffers initially abut against the inner walls of the metal rings having small inside diameters, i.e., the metal rings with small diameters. When the support members are displaced further, buffers other than the aforementioned buffers abut against inner walls of metal rings having medium inside diameters, i.e., metal rings with medium diameters. At this time, the buffers that are held against the metal rings with small diameters are flexed.

When the support members are displaced even further, buffers other than the aforementioned two groups of buffers abut against inner walls of metal rings having maximum inside diameters, i.e., metal rings with maximum diameters. At this time, the buffers that have been held against the metal rings with small diameters are further flexed, and the buffers that have been held against the metal rings with medium diameters are flexed as well.

According to the present invention, the amount of flexure of the metal rings changes depending on the inside diameters of the metal rings and the amount of displacement of the support members. A force tending to spread the metal rings from the inner walls toward the outer walls is lessened, and hence minimum forces, which are required depending on the inside diameters of the metal rings, are applied to the metal rings. As a consequence, the metal rings having small and medium diameters are prevented from becoming plastically deformed.

Since only the required minimum forces are applied to the metal rings, a small sized displacement mechanism (actuator), which produces a small actuating force, can be used for displacing the support members. Consequently, the ring supporting device can be reduced in size and weight.

The ring supporting device may be mounted on a feed mechanism, for example, such that the ring supporting device supports and feeds the ring members upon operation of the feed mechanism.

The ring members preferably comprise metal rings for use in CVTs, for example.

DESCRIPTION OF THE EMBODIMENTS

A ring supporting device according to a preferred embodiment of the present invention will be described in detail below with reference to the accompanying drawings.

Figure 1:
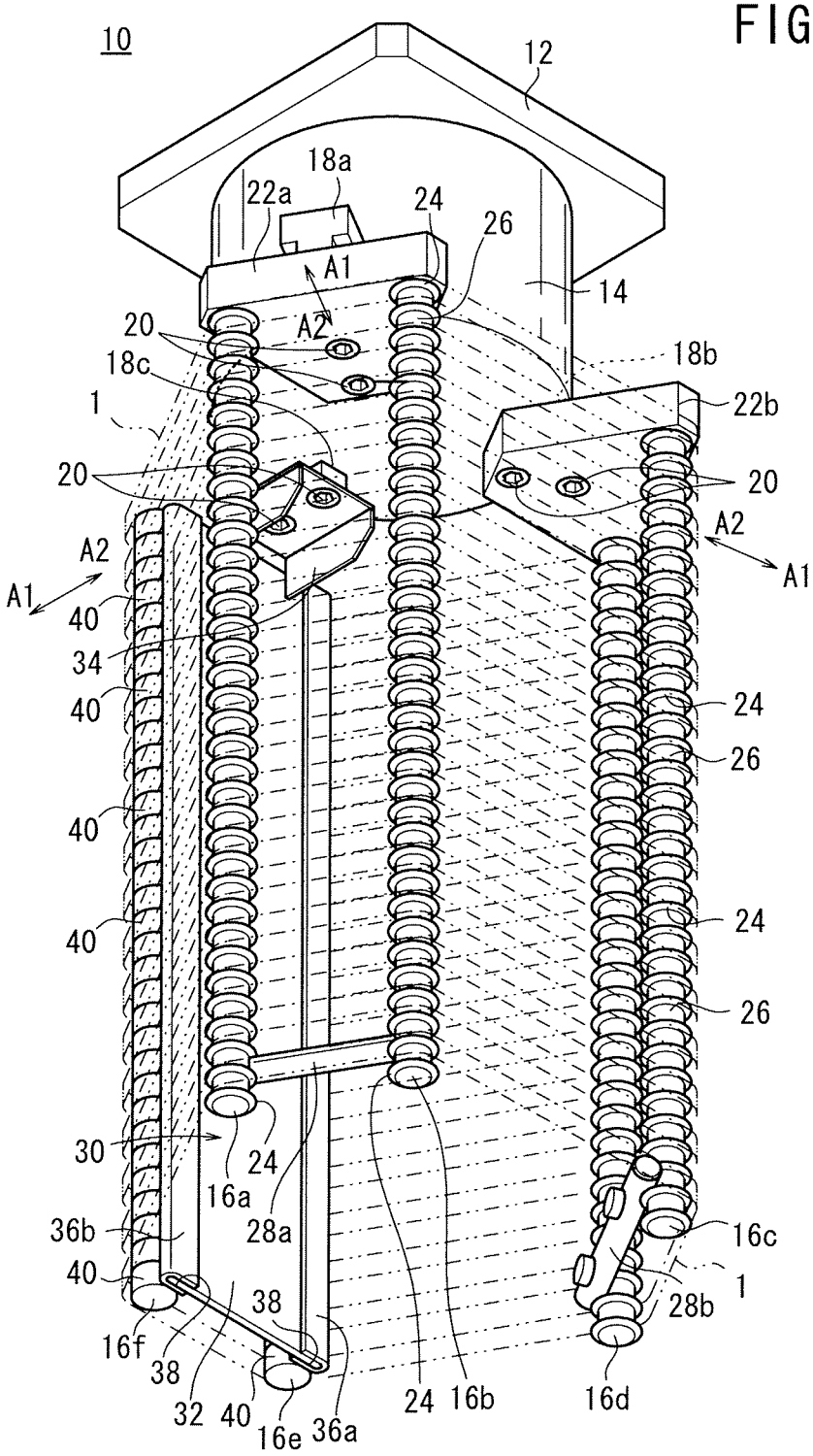
FIG. 1 is a perspective view showing in its entirety a ring supporting device according to an embodiment of the present invention.
Figure 2:
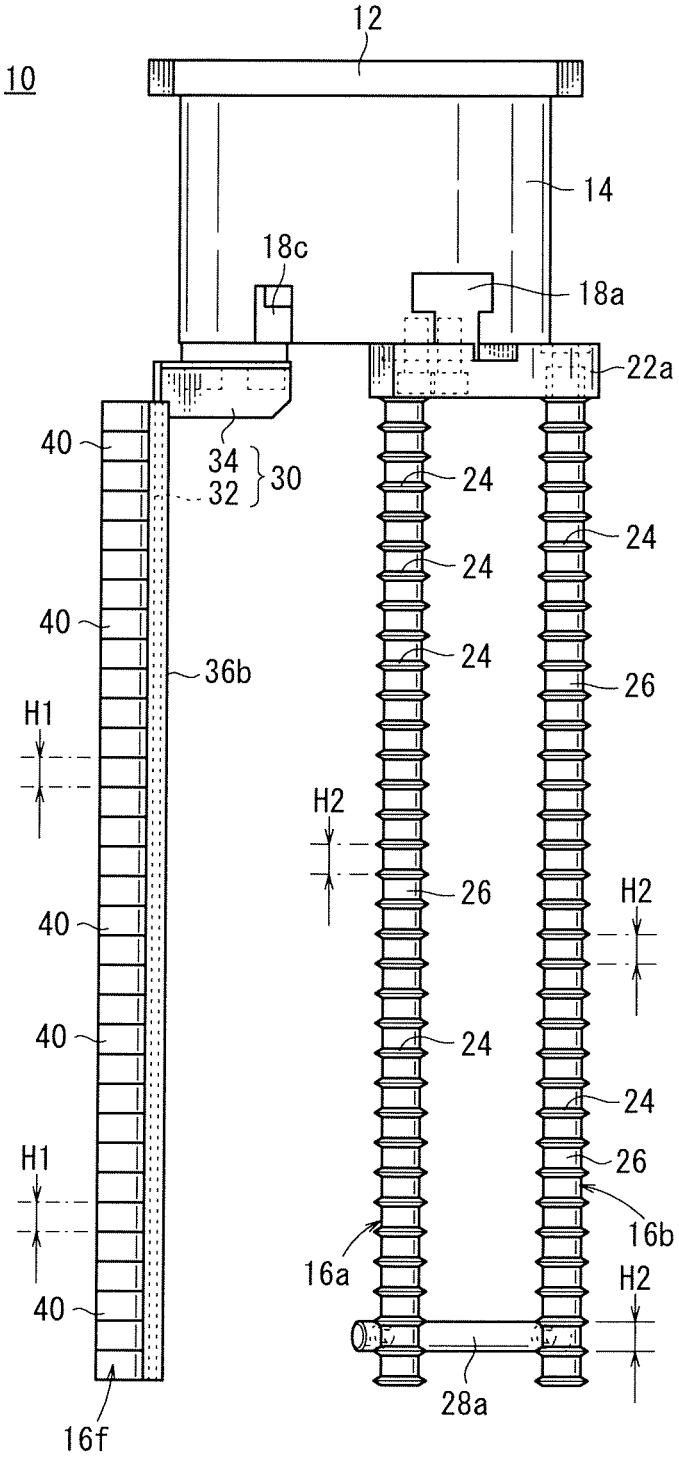
FIG. 2 is a side elevational view of the ring supporting device shown in FIG. 1.

FIG. 1 is a perspective view showing in its entirety a ring supporting device 10 according to an embodiment of the present invention, whereas FIG. 2 is a side elevational view of the ring supporting device 10. In FIG. 1, metal rings 1 are illustrated by imaginary lines. In FIG. 2, the metal rings 1 are omitted from illustration.

The ring supporting device 10 includes a base 12 in the form of a flat plate coupled to the distal end of the arm of a feed robot, not shown, a casing 14 substantially in the form of a cylinder mounted on the base 12 and housing an actuator, a cam, and a return spring (not shown) therein, and six support shafts 16*a* through 16*f* (support members) which hang from the casing 14.

The casing 14 also houses therein three slide members 18*a* through 18*c*, which are displaceable by the cam in the directions indicated by the arrows A1 and A2. Substantially triangular support bases 22*a*, 22*b* are joined by joint bolts 20 to the slide members 18*a*, 18*b*.

Each of the support bases 22*a*, 22*b* supports two of the support shafts 16*a* through 16*f*. More specifically, the support shafts 16*a*, 16*b* are joined to the support base 22*a*, whereas the support shafts 16*c*, 16*d* are joined to the support base 22*b*.

The support shafts 16*a* through 16*d* have respective externally threaded distal ends. Each of the support bases 22*a*, 22*b* has two internally threaded holes (not shown), defined therein. Externally threaded distal ends of the support shafts 16*a* through 16*d* are joined to the support bases 22*a*, 22*b* by being threaded into the internally threaded holes.

Each of the support shafts 16*a* through 16*d* has a predetermined number of annular ridges 24 on a side wall thereof, with recesses 26 defined between adjacent ones of the annular ridges 24. As described later, the metal rings 1 are inserted into the recesses 26.

Position correcting members 28*a*, 28*b*, which serve as bridge members, are mounted on the support shafts 16*a*, 16*b* and on the support shafts 16*c*, 16*d*, in order to prevent lower ends of the support shafts 16*a*, 16*b* and lower ends of the support shafts 16*c*, 16*d* from becoming spaced from each other. More specifically, the position correcting member 28*a* makes the distances between the support shafts 16*a*, 16*b* equal to each other at the support base 22*a* and the position correcting member 28*a*, and similarly, the position correcting member 28*b* makes the distances between the support shafts 16*c*, 16*d* equal to each other at the support base 22*b* and the position correcting member 28*b*.

An elongate support plate 30 for supporting the support shafts 16*e*, 16*f* is joined by joint bolts 20 to the slide member 18*c*. The support plate 30 includes a flat plate portion 32 and a joint tab 34, which is bent substantially at a right angle from the flat plate portion 32. The joint tab 34 is joined to the slide member 18*c*.

Rim members 36*a*, 36*b* are fitted respectively over edges of the flat plate portion 32. The rim members 36*a*, 36*b* have respective U-shaped grooves 38 defined therein. Respective edges of the flat plate portion 32 are fitted into the U-shaped grooves 38.

The support shafts 16*e*, 16*f* are mounted on end faces of the rim members 36*a*, 36*b*. In other words, the support shafts 16*e*, 16*f* are positioned on and fixed to the flat plate portion 32 of the support plate 30 by the rim members 36*a*, 36*b*.

A plurality of elastic buffers 40 are bonded by an adhesive to side walls of the support shafts 16*e*, 16*f*. Stated otherwise, the support shafts 16*e*, 16*f* are covered by the buffers 40.

Each of the buffers 40 has a vertical dimension H1 (see FIG. 2), which corresponds substantially to (is substantially aligned with) the vertical dimension H2 of each of the recesses 26. Adjacent buffers 40, which are positioned next to each other, are disposed adjacent to each other at positions that are substantially aligned with the positions of each annular ridge 24. The buffers 40 may be formed by winding a single buffer sheet around each of the support shafts 16*e*, 16*f*, joining the buffer sheet thereto, and thereafter cutting the buffer sheet at positions corresponding substantially to positions of the annular ridges 24. Alternatively, the buffers 40, the vertical dimension of which corresponds substantially to the vertical dimension of the recesses 26, may individually be wound around and joined to the support shafts 16*e*, 16*f*.

The buffers 40 preferably are made of an elastic material such as sponge, or any of various rubbers, although the buffers 40 may be made of any type of elastic material.

The ring supporting device 10 according to the present embodiment is constructed basically as described above. Operations and advantages of the ring supporting device 10 will be described below.

Figure 3:
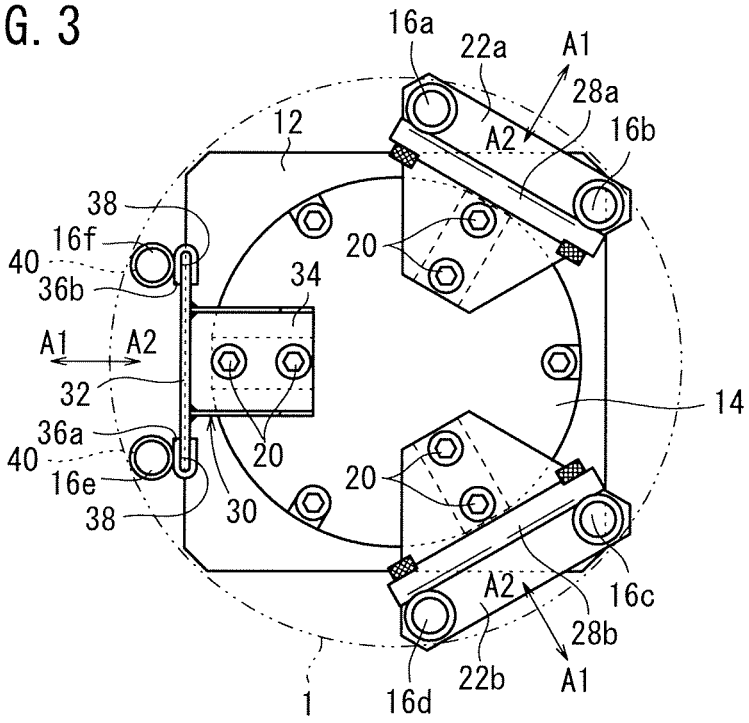
FIG. 3 is a bottom view of the ring supporting device shown in FIG. 1.

The ring supporting device 10 supports the metal rings 1 in the following manner. As shown at the bottom of FIG. 3, the support shafts 16*a* through 16*f* are inserted into a plurality of metal rings 1 that are stored in a vertical array, while being spaced from inner walls of the metal rings 1.

Then, the actuator is actuated to cause the cam to press the slide members 18*a* through 18*c*, so that the slide members 18*a* through 18*c* are displaced radially away from each other along the directions indicated by the arrows A1. Thus, the support shafts 16*a* through 16*f*, which are supported on the slide members 18*a* through 18*c* through the support bases 22*a*, 22*b* and the support plate 30, move toward the inner walls of the metal rings 1. The slide members 18*a* through 18*c* are displaced at substantially the same speed.

Figure 4:
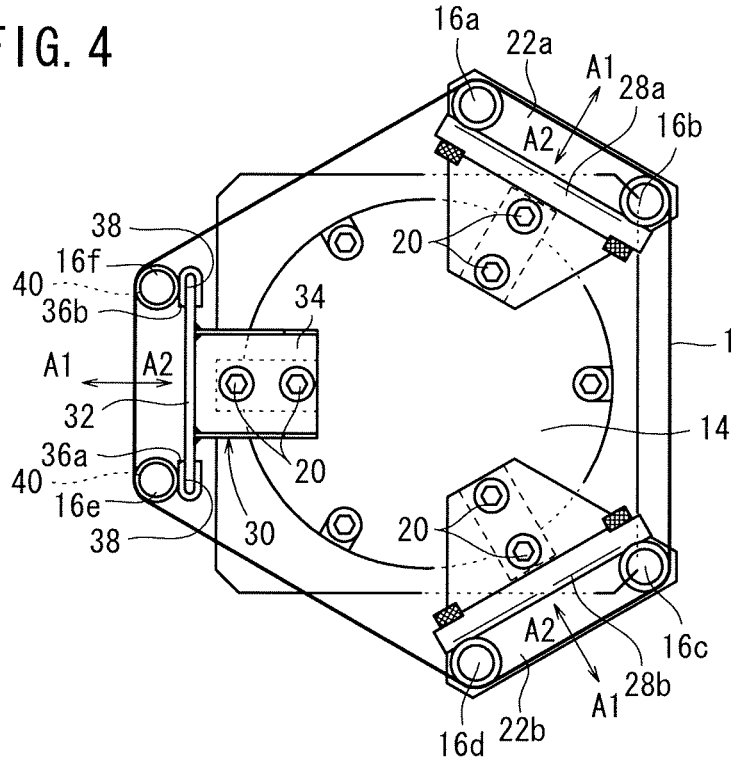
FIG. 4 is a bottom view showing the manner in which the ring supporting device shown in FIG. 1 supports metal rings (ring members) along inner walls thereof.

While the slide members 18*a* through 18*c* are displaced, as shown in FIG. 4, some of the bottoms of the recesses 26 of the support shafts 16*a* through 16*d*, and some of the buffers 40, which cover the support shafts 16*e*, 16*f*, are brought into abutment against inner walls of the metal rings 1, the inside diameter of which is small due to manufacturing errors and tolerances. Such metal rings 1 are thus elastically deformed into a hexagonal shape.

The slide members 18*a* through 18*c* are continuously displaced in order to bring the support shafts 16*a* through 16*f* into abutment against inner walls of the metal rings 1 that have a maximum inside diameter. Consequently, the metal rings 1 having a small diameter, which have inner walls thereof already held against the support shafts 16*a* through 16*f*, undergo a force that tends to spread the metal rings 1 away from the inner walls and toward the outer walls thereof.

According to the present embodiment, as described above, the buffers 40 are disposed on the support shafts 16*e*, 16*f*. Therefore, a force tending to spread the metal rings 1 having a small diameter acts on the buffers 40, and the force is lessened as the metal rings 1 press the buffers 40 to cause flexure thereof.

At this time, only those buffers 40 which are held against the inner walls of the metal rings 1 are flexed, whereas the other buffers 40 are not flexed. This is because only one of the buffers 40 on each of the support shafts 16*e*, 16*f* abuts against one metal ring 1, whereas the other buffers 40 do not abut against the metal ring 1.

Then, the support shafts 16*a* through 16*f* abut against inner walls of metal rings 1 having a medium diameter. Therefore, such metal rings 1 undergo a force that tends to spread the metal rings 1 from the inner walls and toward the outer walls thereof.

The force also is reduced as the metal rings 1 having the medium diameter press the buffers 40 on the support shafts 16*e*, 16*f* to undergo flexure. At this time, the metal rings 1 having the small diameter further flex the buffers 40, which are held against the inner walls thereof.

Finally, the support shafts 16*a* through 16*f* abut against the inner walls of the metal rings 1 having the maximum inside diameter. At this time, the buffers 40, which are held against the inner walls of the metal rings 1 having the maximum diameter, are slightly flexed. The buffers 40, which are held against the inner walls of the metal rings 1 having the medium diameter, are further flexed. The buffers 40, which are held against the inner walls of the metal rings 1 having the small diameter, are still further flexed. Therefore, the metal rings 1 are held by the support shafts 16*a* through 16*f* under gripping forces that depend on the inside diameters of the metal rings 1 (see FIG. 1).

Since as many buffers 40 are provided on each support shaft as the number of metal rings 1, the individual buffers 40 perform a force reducing function on each of the metal rings 1. Therefore, the metal rings 1 are supported under gripping forces that depend on the amount of flexure of the buffers 40.

According to the present embodiment, therefore, minimum required forces, which depend on the different inside diameters of the metal rings 1, can simultaneously be applied to the metal rings 1. Therefore, the metal rings 1 having the small inside diameter are prevented from becoming plastically deformed.

Since minimum required forces are applied, an actuator that produces a small actuating force, or stated otherwise, an actuator that is small in size, can be used.

Figure 5:
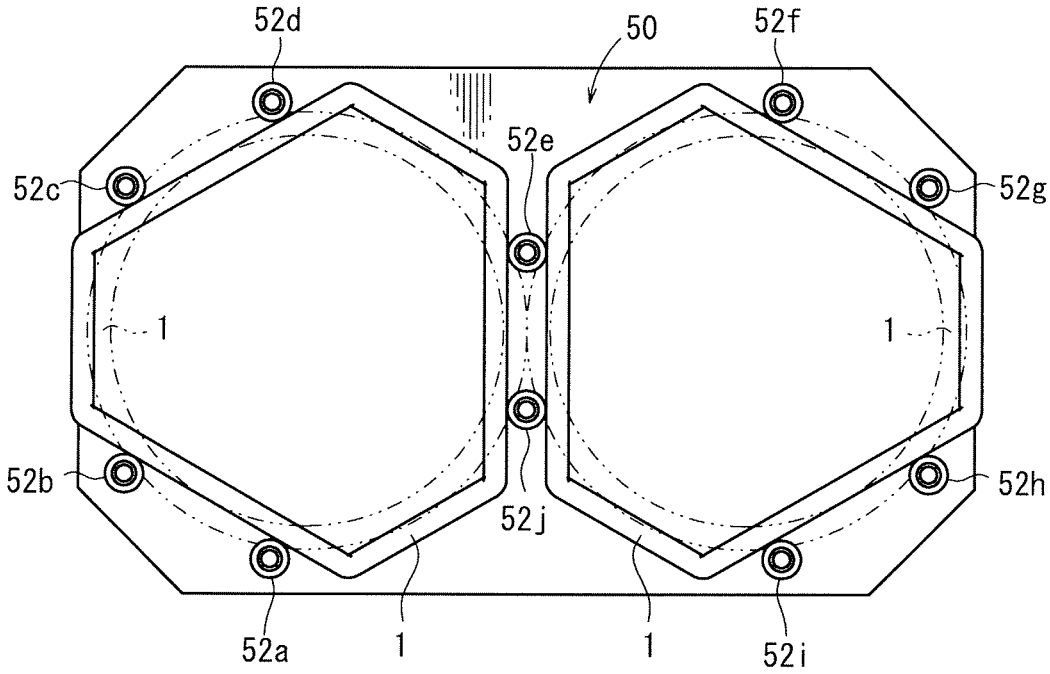
FIG. 5 is a plan view showing the manner in which gripped metal rings are fed onto a rack.
Figure 6:
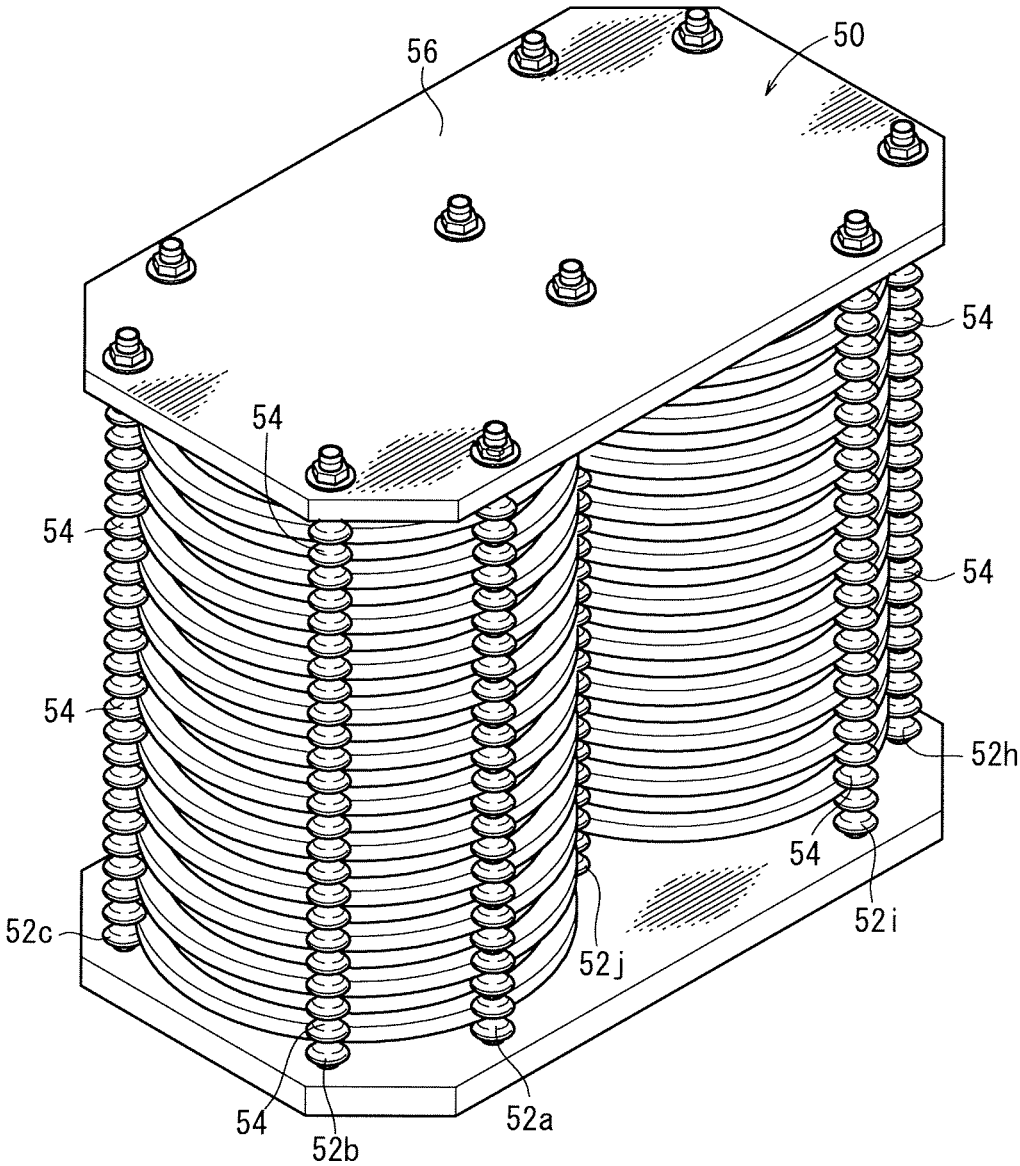
FIG. 6 is a perspective view showing the manner in which the metal rings are held by the rack.
Figure 7:
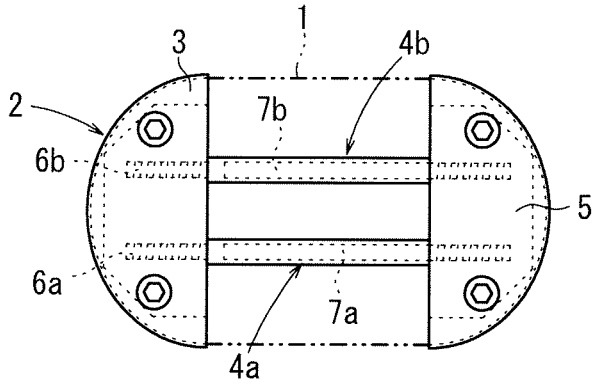
FIG. 7 is a plan view of a ring supporting device according to the background art.
Figure 8:
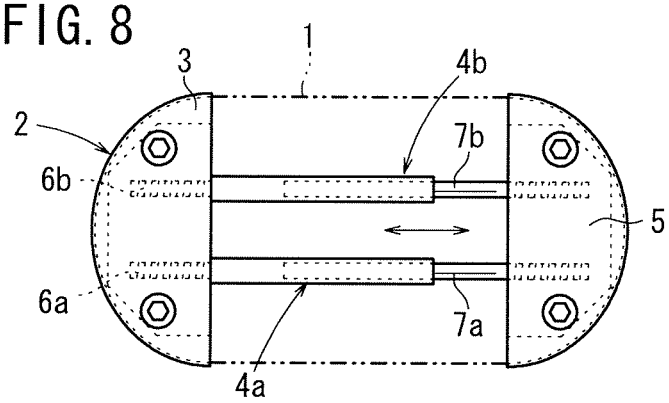
FIG. 8 is a plan view showing the manner in which the rods of cylinders of the ring supporting device according to the background art are extended.
Figure 9:
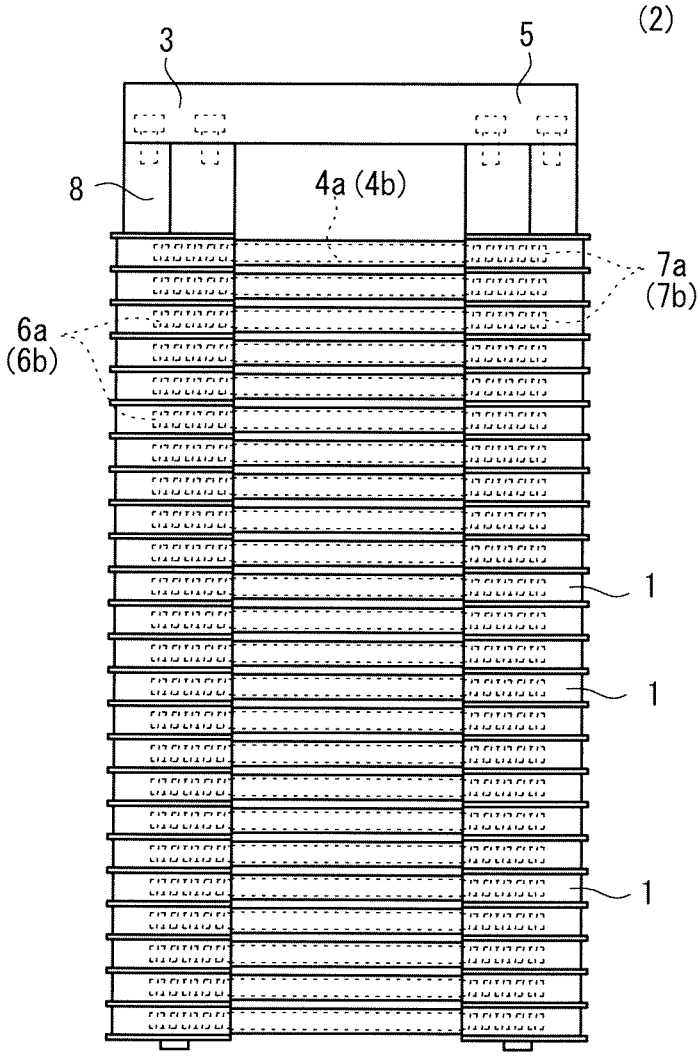
FIG. 9 is a side elevational view of the ring supporting device shown in FIGS. 7 and 8.

Then, as shown in FIG. 5, the metal rings 1 are moved together with the ring supporting device 10 onto a rack 50 by the arm of the feed robot. The support shafts 16*a* through 16*f* are inserted between a plurality of holding shafts 52*a* through 52*e*, 52*j* of the rack 50. Thereafter, the actuator is actuated again so as to urge the slide members 18*a* through 18*c* under the resiliency of the return spring, so that the slide members 18*a* through 18*c* are displaced toward each other in the directions indicated by the arrows A2 (see FIGS. 1, 3 and 4).

Upon displacement of the slide members 18*a* through 18*c*, the support shafts 16*a* through 16*f* become spaced from the inner walls of the metal rings 1. Therefore, the metal rings 1 return elastically to their circular shape. When the outer walls of the metal rings 1 engage within recesses 54 defined in the holding shafts 52*a* through 52*e*, 52*j*, the metal rings 1 are held by the holding shafts 52*a* through 52*e*, 52*j*. Similarly, the metal rings 1 are held by the holding shafts 52*e* through 52*j*.

Thereafter, a top plate 56 of the rack 50 is joined to distal ends of all of the holding shafts 52*a* through 52*f*, whereby the metal rings 1 are held by the rack 50. Thereafter, the metal rings 1 are fed together with the rack 50 into a heat treatment furnace, and the metal rings 1 are heated in the heat treatment furnace according to a nitriding treatment process or the like.

In the above-described embodiment, metal rings 1 for use in CVTs have been illustrated as constituting the ring members. However, the ring members are not limited to metal rings, but may be any type of elastic ring members, for example, rubber rings.

In the above-described embodiment, the buffers 40 are mounted only on the support shafts 16*e*, 16*f*. However, the buffers 40 may be mounted on all of the support shafts 16*a* through 16*f*.

In the above-described embodiment, all of the support shafts 16*a* through 16*f* are displaced together simultaneously. However, one, two or more of the support shafts 16*a* through 16*f* may be displaced.

The number of support shafts 16*a* through 16*f* is not limited to six, but rather, as many support shafts as required to hold the ring members may be provided.

The invention claimed is:

1. A ring supporting device comprising a plurality of support members for simultaneously supporting a plurality of elastic ring members from inner walls thereof, wherein:

at least one of the support members is displaceable toward or away from the inner walls of the ring members;

at least one of the support members is covered with a plurality of elastic buffers; and when the ring members are supported by the support members, the buffers abut individually and respectively against the ring members.

2. The ring supporting device according to claim 1, wherein the ring supporting device is mounted on a feed mechanism, and supports and feeds the ring members upon operation of the feed mechanism.

3. The ring supporting device according to claim 1, wherein the support members comprise cylindrical members each having a plurality of annular ridges projecting from side walls thereof, and wherein the ring members are inserted into recesses defined between adjacent ones of the annular ridges.

4. The ring supporting device according to claim 3, wherein each of the buffers has a vertical dimension, which is aligned substantially with a vertical dimension of each of the recesses.

5. The ring supporting device according to claim 1, further comprising a bridge member interconnecting adjacent ones of the support members.

6. The ring supporting device according to claim 1, wherein the ring supporting device supports metal rings as the ring members.

* * * * *